US006264764B1

(12) United States Patent
Kamf et al.

(10) Patent No.: US 6,264,764 B1
(45) Date of Patent: Jul. 24, 2001

(54) COPPER ALLOY AND PROCESS FOR MAKING SAME

(75) Inventors: Anders Claes Kamf, East Amherst; M. Parker Finney, Lockport, both of NY (US)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/568,313

(22) Filed: May 9, 2000

(51) Int. Cl.[7] ..... C22C 9/02
(52) U.S. Cl. ..... 148/433; 420/473
(58) Field of Search ..... 420/473; 148/433

(56) References Cited

U.S. PATENT DOCUMENTS

| | | | |
|---|---|---|---|
| 5,429,794 | 7/1995 | Kamf et al. | 420/477 |
| 5,853,505 | 12/1998 | Brauer et al. | 148/433 |
| 5,893,953 | 4/1999 | Bhargava | 148/685 |
| 5,916,386 | 6/1999 | Bhargava | 148/554 |
| 6,059,901 * | 5/2000 | Sahu | 148/442 |

FOREIGN PATENT DOCUMENTS

| | | | |
|---|---|---|---|
| 49-122420 * | 11/1974 | (JP) . | |
| 60-086231 * | 5/1985 | (JP) . | |
| 60-086233 * | 5/1985 | (JP) . | |
| 60-174843 * | 9/1985 | (JP) . | |
| 61-243141 * | 10/1986 | (JP) . | |
| 63-026320 * | 2/1988 | (JP) . | |
| 1162737 * | 6/1989 | (JP) . | |
| 7026341 * | 1/1995 | (JP) . | |
| 7011123 * | 2/1971 | (NL) . | |

OTHER PUBLICATIONS

Olin Corporation Sales Brochure, Characteristics and Application of Olin Alloy C663, 1998.

Olin Corporation PDF document, "Olin C663".

* cited by examiner

*Primary Examiner*—Sikyin Ip
(74) *Attorney, Agent, or Firm*—Morgan & Finnegan, L.L

(57) ABSTRACT

Copper alloys for electrical applications, particularly in the computer industry, and a process for making the copper alloys. The copper alloys contain 13–15% by weight of zinc, 0.7–0.9% by weight of tin, and 0.7–0.9% by weight of iron, the balance being copper. The low tin and iron content and high zinc content provide high tensile and yield strengths, a high conductivity, and a low cost for the copper alloys.

4 Claims, 4 Drawing Sheets

COPPER ALLOY AND PROCESS FOR MAKING SAME

BACKGROUND OF THE INVENTION

1. Field of Invention

The present invention generally relates to copper base alloys having utility in electrical applications and to a process for making the copper base alloys.

2. Description of Prior Art

Electronic components, including connectors, form the basis of information technology, especially in computers. One of the most important considerations in any connector design is to optimize performance at the lowest cost. As computer prices continue to decline, there is a need in the computer industry for, inter alia, alternative materials to those presently used as electrical components that possess the desirable properties of high electrical and thermal conductivity, high yield and tensile strengths, and that are cost effective.

Copper alloys are typically used as connectors and in other electrical and thermal applications because of their generally superior corrosion resistance, high electrical and thermal conductivity, and good bearing and wear qualities. Copper alloys also are useful for their good cold or hot-working properties and machinability.

Copper is alloyed with other metals primarily to increase tensile strength of the alloy. However, electrical and thermal conductivities, corrosion resistance, formability and color of the alloy are strongly affected by alloying copper with other elements. For example, when alloying elements are present in significant concentrations or when low concentrations of deoxidized elements are present, they tend to decrease electrical and thermal conductivity of a copper alloy.

The addition of beryllium to copper results in a significant age hardening response, making these copper alloys one of the few non-ferrous materials that can reach 200 ksi tensile strength. Beryllium copper alloys, however, are very expensive, are limited in their forming ability, and often require extra heat treatment after preparation, further adding to the cost.

Phosphor bronze copper alloys have high strengths, excellent forming properties, and are widely used in the electronic and telecommunications industries. However, the addition of high amounts of tin increases the cost of these alloys.

Copper alloys that include small quantities of tin and zinc provide many desirable properties. One tin brass alloy, commercially available as C42500 (as specified in the ASM Handbook), has a composition of 87%–90% copper, 1.5%–3.0% of tin, a maximum of 0.05% of iron, and a maximum of 0.35% phosphorous, the balance being zinc. The ASM Handbook specifies that the copper alloy designated as C42500 has a nominal electrical conductivity of 28% International Annealed Copper Standard (IACS). This is the traditional way of comparing the conductivity of other metals and copper alloys with high conductivity copper where "pure" copper is assigned a conductivity value of 100% ICAS at 20 degrees Celsius. C42500 also has a yield strength, dependent on temper, of between 45 ksi and 92 ksi. This alloy is used for many electrical applications, such as electrical switch springs, terminals, connectors, and fuse clips. However, its yield strength is lower than desired (i.e., approximately 22 ksi at 40% reduction) for electrical applications.

U.S. Pat. No. 5,853,505 to Brauer et al ("the Brauer '505 patent") describes a tin brass alloy that has been annealed twice at a temperature between about 400 degrees Celsius and 600 degrees Celsius to a grain size of 0.002 mm and contains from 1% to 4% by weight of tin, from 0.8% to 4.0% by weight of iron, up to 0.4% by weight of phosphorous, and the balance being copper.

According to the Brauer '505 patent, when a tin content less than 1.5% is used, the copper alloy lacks adequate strength and resistance to stress relaxation for spring application. The Brauer '505 patent also specifies that the addition of zinc to the alloy would be expected to provide a moderate increase in strength with some decrease in electrical conductivity.

Example 2 in the Bauer '505 patent describes a copper alloy containing 10.4% by weight of zinc, 1.8% by weight of iron, 0.04% by weight of phosphorous, between 1.8% and 4.0% by weight of tin, the balance being copper. An embodiment of the tin brass alloy containing the composition of example 2 in the Brauer '505 patent is commercially available from Olin Corporation as C663. The C663 alloy is available from Olin Corporation with compositions containing from 1.4% to 2.4% by weight of iron, from 1.5% to 3.0% by weight of tin, from 84.5% to 87.5% by weight of copper, up to 0.35% by weight of phosphorous, and the balance being zinc.

Olin Corporation specifies that C663 possesses, depending on the temper, a yield strength of 100 ksi and a tensile strength between 95 ksi and 110 ksi for spring temper, a yield strength of 104 ksi and a tensile strength between 100 ksi and 114 ksi for extra spring temper, and a yield strength of 105 ksi (min) and a tensile strength of 105 ksi (min) for super spring temper. Olin Corporation also specifies that these alloys have an electrical conductivity of 25% ICAS, as annealed. However, these alloys are undesirable because of their high copper content resulting in a higher cost.

There exists a need for a cost effective alternative to existing copper alloys that will still possess high electrical conductivity, high tensile strength, and high yield strength.

SUMMARY OF THE INVENTION

Copper alloys have been discovered that provide higher tensile and yield strengths and a higher electrical conductivity than prior art copper alloys, but which reduce the amounts of copper in the alloy, and a process for making same. More particularly, copper alloys have been discovered having tensile strengths greater than 110 ksi and less than 130 ksi, yield strengths greater than 100 and less than 120 ksi and electrical conductivity greater than 25% ICAS and less than 35% ICAS, as annealed.

In one aspect, the present invention is directed to a copper alloy consisting essentially of 13% to 15% by weight of zinc, 0.7% to 0.9% by weight of tin, 0.7% to 0.9% by weight of iron, the balance being copper.

In another aspect, the present invention is directed to a process for making the copper alloy that employs only one annealing step at a temperature between 400° C. and 600° C. The process comprises the steps of:

casting a copper alloy consisting essentially of 13% to 15% by weight of zinc, 0.7% to 0.9% by weight of tin, 0.7% to 0.9% by weight of iron, the balance being copper;

hot rolling the cast copper alloy at a temperature between 800° C. and 950° C. to reduce its thickness to 80% to 95% of the original thickness of the copper alloy;

annealing the reduced copper alloy for a time period between about three and about eight hours at a temperature between about 450° C. and 575° C.;

roll reducing the annealed copper alloy to produce a second reduction of thickness of up to 70% in the copper alloy; and relief annealing the twice reduced copper alloy for a time period between about three and about eight hours at a temperature between 200° C. and 280° C.

In an alternate embodiment, the process of making the copper alloy is carried out in the absence of a hot rolling step. The process comprises:

vertical upward casting a copper alloy consisting essentially of 13% to 15% by weight of zinc, 0.7% to 0.9% by weight of tin, 0.7% to 0.9% by weight of iron and the balance being copper;

rolling the vertical upward casting copper alloy to reduce its thickness at least around 60% of the original thickness of the copper alloy;

annealing the reduced copper alloy for a time period between three and eight hours at a temperature between about 450° C. and about 575° C;

cold rolling the annealed copper alloy to reduce its thickness up to 70%; and, thereafter, relief annealing the cold rolled copper alloy for a time period between about three and about eight hours at a temperature between about 200° C. to 280° C.

DETAILED DESCRIPTION OF THE INVENTION

Figure 1:
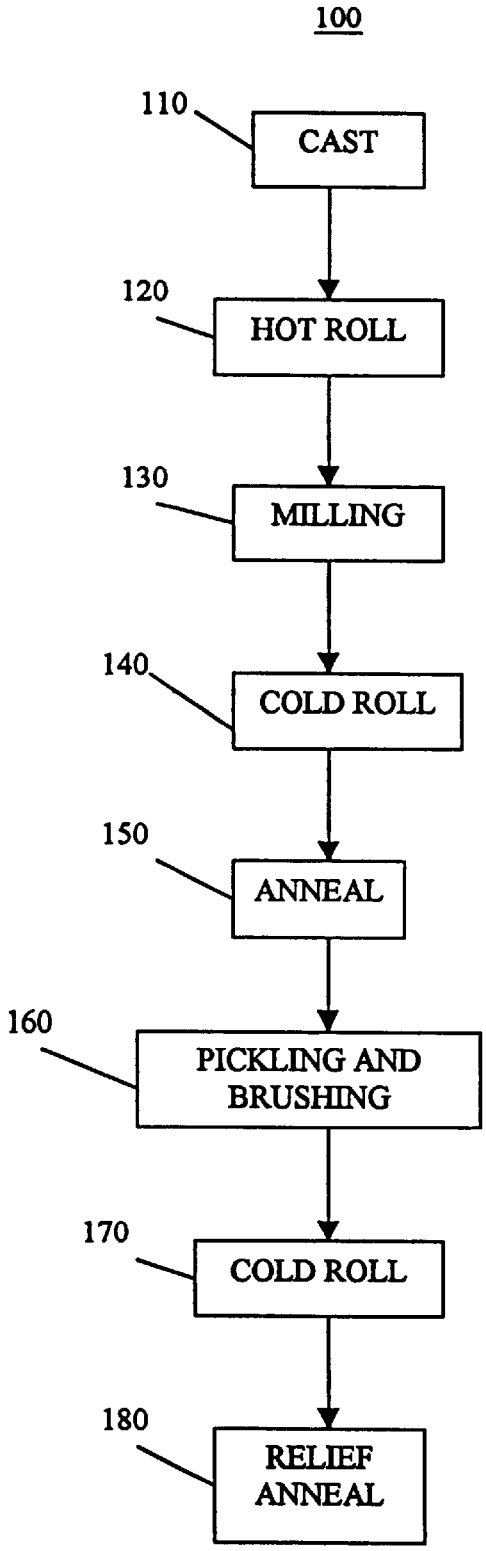
FIG. 1 is a flow chart illustrating the steps of a first method of processing the copper alloy.

Copper base alloys of the present invention consist essentially of 13% to 15% by weight of zinc, 0.7% to 0.9% by weight of tin, 0.7% to 0.9% by weight of iron, the remainder being copper along with inevitable impurities in insignificant quantities.

Other elements, such as silver, nickel, phosphorus, aluminum, silicon, chromium, indium, antimony, titanium, tellurium, sulfur, lithium, magnesium, manganese, zirconium or beryllium, may be included in copper alloys of this invention. These materials may be included in amounts less than 0.1%, each generally in excess of 0.001 each. The use of one or more of these materials improves mechanical properties of the copper alloys such as stress relaxation properties; however, when these materials are present in the copper alloys, they may affect conductivity, strength and forming properties of the copper alloys.

Each of the alloying elements in the copper alloys of this invention (i.e., tin, iron, and zinc) when added to copper have specific effects on the copper alloy's properties.

The addition of tin in an amount between 0.7% and 0.9% increases strength and hardness of the copper alloys of the invention and also increases their resistance to stress relaxation. Tin also enhances corrosion resistance of copper-base alloys in non-oxidizing media. However, increasing the amount of tin too much (by, for example 10% to 20%) negatively affects electrical conductivity and makes the alloys more difficult to process, particularly during hot processing.

The tin range employed in the copper alloys of the present invention, 0.7% to 0.9%, differs from the tin range of the alloys described in the Brauer '505 patent. As mentioned above, the Brauer '505 patent states that when the tin content is less than 1.5%, the alloys lack adequate strength and resistance to stress relaxation for spring applications. However, as will be illustrated in more detail below, it has been discovered that the copper alloys of this invention have high tensile and yield strengths, complemented by a high electrical conductivity. These desired characteristics are achieved by a proper balance of tin, iron, and zinc.

The addition of iron in amounts between 0.7% and 0.9% refines the microstructure of the as-cast copper alloy and increases its strength. Iron also promotes a fine grain structure by acting as a grain growth inhibitor. However, as disclosed in the Brauer '505 patent, an iron content in excess of 2.2% by weight decreases the electrical conductivity of copper alloys because of the formation of large stringers.

The iron range employed in the copper alloys of this invention, 0.7% to 0.9%, also differs from the iron range of the alloys disclosed in the Brauer '505 patent. It has been found that with a lower tin and a lower iron content, the copper alloys of the present invention unexpectedly possess increased electrical conductivity and strength, as shown hereinafter. Furthermore, with a lower iron content, the iron particles more easily distribute through the copper alloy during annealing step(s) used in making the copper alloys.

The addition of zinc to a copper alloy would be expected to provide a moderate increase in strength with some decrease in electrical conductivity. Zinc typically increases the tensile strength of a copper alloy at a significant rate up to a concentration of approximately 20%, whereas the tensile strength increases only slightly more for additions of zinc of 20–40%.

The effective zinc range in the copper alloys of the present invention, 13% to 15%, is, for example, greater than the preferred range of 8% to 12% disclosed in the Brauer '505 patent. However, a discovery of the present invention is that the addition of more zinc and less tin and iron unexpectedly resulted in higher strengths and higher electrical conductivity than prior art copper alloys, as will be illustrated below.

Since one of the most important considerations in any connector design is to optimize performance at the lowest cost, the metal value, based on nominal chemistry, for the copper alloys of the present invention is reduced because of the lower copper content, the lower tin addition, and the less expensive addition of zinc.

PRODUCTION METHOD

The mechanical properties of cast copper alloys are a function of alloying elements and their concentrations and the process by which these alloys are produced. In one embodiment, the copper alloys of the present invention are processed according to the flow chart illustrated in FIG. 1.

Initially, the process 100 of the present embodiment includes casting 110 an alloy having a composition of 13% to 15% by weight of zinc, 0.7% to 0.9% by weight of tin, 0.7% to 0.9% by weight of iron, and the balance being copper. In one embodiment, the copper alloy is formed into a pilot strip by, for example, continuous casting. Continuous casting involves continuously pouring molten metal into the top of a water-cooled, lubricated mold. A solid cast shape is continuously withdrawn mechanically from the bottom of the mold. The process is continuous as long as molten metal is available and the mold does not wear out. In alternative embodiments, any conventional casting technique known in the art, such as, for example, spray, direct chill or the like, can be used.

The copper alloy is then hot rolled 120 at 800 to 950 degrees Celsius. Typically, the hot rolling reduction is, by thickness, from about 80% to about 95%, and, preferably, to about 90%. Rolling results in substantial elongation of the cast slab. Some advantages to hot rolling the copper alloy are grain refinement, reduction of segregation, healing of defects, such as porosity, and dispersion of inclusions. The hot rolling may be a single pass or by multiple passes.

One disadvantage of hot rolling is the formation of oxide surface scales on the surface of the hot rolled copper alloy. Thus, after the material is hot rolled, the surface of the hot-rolled product is milled 130 to remove the oxide surface layer that exists after hot rolling.

After the surface is milled, the alloy is cold rolled 140 down, for example, 0.023 inches, to a ready to finish surface. Cold rolling increases the low temperature strength because of derformation hardening and provides close dimension control and a good surface finish.

Grain refinement can be achieved by annealing 150, which entails heating, after cold rolling, to a temperature at which re-crystallization of the elements in the alloy occurs. The alloy is annealed at 450 to 575 degrees Celsius for between 3 to 8 hours.

In annealing, the cold-rolled material is heated to soften it and improve its ductility. It should be understood that only one annealing step is required with the copper alloys of the present invention. It was found that because less iron is being used, there is no need for two annealing steps. The iron content of the present invention was found to be evenly distributed after only one annealing step.

After annealing, the surface of the alloy can be cleaned by pickling and brushing 160. The alloy then is reduced a second time 170, typically up to 70% and, preferably, between 10% and 70%. The amount of reduction is dependent on the temper.

The alloy then is relief annealed 180 at 200 to 280 degrees Celsius for between 3 to 8 hours. Relief annealing reduces internal stresses and improves formability by heating the copper alloy to some higher temperature.

The copper alloy strip then is flattened by a method known as Stretch Bend Leveling, or by other method well known in the art, and formed into the desired product, such as, for example, an electrical connector. The copper alloys enjoy a variety of excellent properties making them suitable for use as electrical connectors and other electrical applications. Among the advantages of these alloys are increased yield and tensile strengths without degradation to electrical conductivity.

Figure 2:
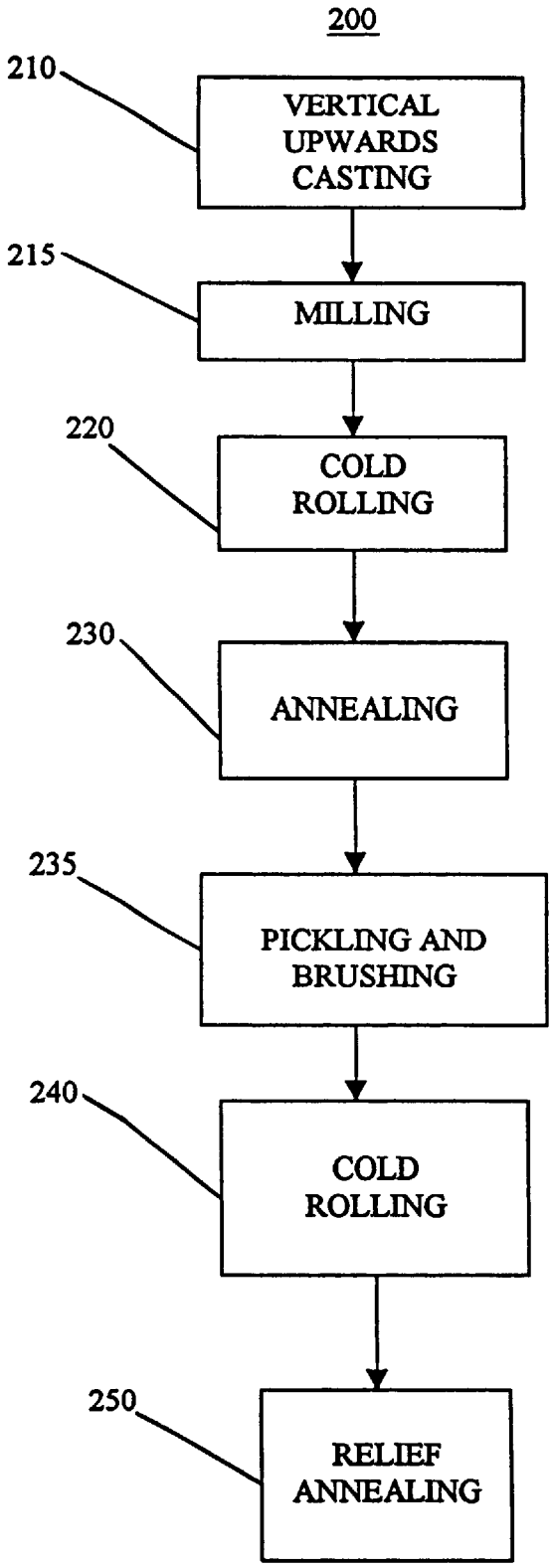
FIG. 2 is a flow chart illustrating the steps of a second method of processing the copper alloy.

In an alternate embodiment, the copper alloys of the invention are processed according to the flow chart illustrated in FIG. 2. In this embodiment, a copper alloy having the composition of elements according to the present invention is produced by first continuous casting, for example vertical upwards casting 210, the alloy. Vertical upwards casting is the process of continuously drawing upward a supply of melt by suction through a vertical graphite nozzle, the upper portion of which is cooled to solidify the melt enough in the nozzle to endure pulling the solidified product upwards through a cooler having a cross-section which is somewhat greater than that of the product. Further information relating to upcasting, or continuous methods and apparatus for upwards casting, is found in U.S. Pat. No. 3,746,077 to Lohikoski et al, issued Jul. 17, 1973, U.S. Pat. No. 3,872,913 to Lohikoski, issued Mar. 25, 1975, U.S. Pat. No. 5,381,853 to Koivisto et al, issued Jan. 17, 1995, and U.S. Pat. No. 5,404,932 to Koivisto et al, issued Apr. 11, 1995, the disclosures of which are incorporated herein by reference.

After continuous casting, for instance vertical upwards casting, the copper alloy can be milled 215 and then cold rolled 220 to a reduction of at least around 60%, by thickness; annealed 230 at 450 to 575 degrees Celsius for 3 to 8 hours, after which pickling and brushing 235 can be done, cold rolled 240 again to a reduction of, typically, by thickness, up to 70%, and, finally, relief annealed 250 at 200 to 280 degrees Celsius for 3 to 8 hours. By using the casting process 200, the copper alloy does not have to be hot rolled, thus reducing the costs of producing the alloy because high temperature heaters are not required and cold rolling produces better surface finishes than hot rolling.

The alloys processed, according to the production methods as described above, possess the desirable properties for use in electrical connectors and other electrical applications.

It is believed that copper alloys of this invention are capable of achieving a tensile strength, at about 70% reduction, of greater than 110 ksi, preferably greater than 112 ksi, and more preferably greater than 115 ksi, and a tensile strength of less than 130 ksi, preferably less than 125, and more preferably less than 120 ksi.

It is further believed that copper alloys of this invention are capable of achieving a 0.2% yield strength, at about 70% reduction, of greater than 100 ksi, preferably greater than 105 ksi, and more preferably greater than 110 ksi, and also a yield strength of less than 120 ksi, preferably less than 118 ksi, and more preferably less than 115 ksi.

It is also believed that copper alloys formed in accordance with the processes of the present invention and having the aforesaid compositions are capable of achieving an electrical conductivity of greater than 25% IACS, and, more preferably, greater than 27% IACS, as annealed, and an electrical conductivity of less than 35% IACS, and, more preferably, less than 33% IACS, as annealed.

Moreover, it is believed that copper alloys formed in accordance with the processes of the present invention and having the aforesaid compositions are capable of achieving an electrical conductivity of greater than 25% ICAS, and, more preferably, greater than 27% ICAS, as rolled to temper, and an electrical conductivity of less than 33% ICAS, and, more preferably, less than 31% ICAS, as rolled to temper.

The copper alloys of this invention are believed to achieve unexpected and improved electrical conductivity because of the lower tin and iron content therein, compared to known prior art copper alloys.

EXAMPLE 1

Table 1, below, illustrates the average mechanical properties of two samples of a copper alloy containing 10.7% by weight of zinc, 0.8% by weight of tin, 1.8% by weight of iron and the balance being copper which was prepared by casting at 12 mm, rolling to 1 mm (92% reduction), and annealing at 525 degrees Celsius for 4 hours to a grain size of 2–3 micrometers. This copper alloy corresponds with the copper alloy described in example 2 of the Brauer '505 patent, but having less tin content.

TABLE 1

| % Reduction | Yield Strength | Tensile Strength | Elongation |
|---|---|---|---|
| 0 | 54.5 | 68.9 | 24 |
| 15 | 80.6 | 81 | 5 |
| 30 | 87.2 | 88 | 4 |
| 50 | 95 | 97.6 | 3 |
| 70 | 97.6 | 103 | 3 |

Figure 3:
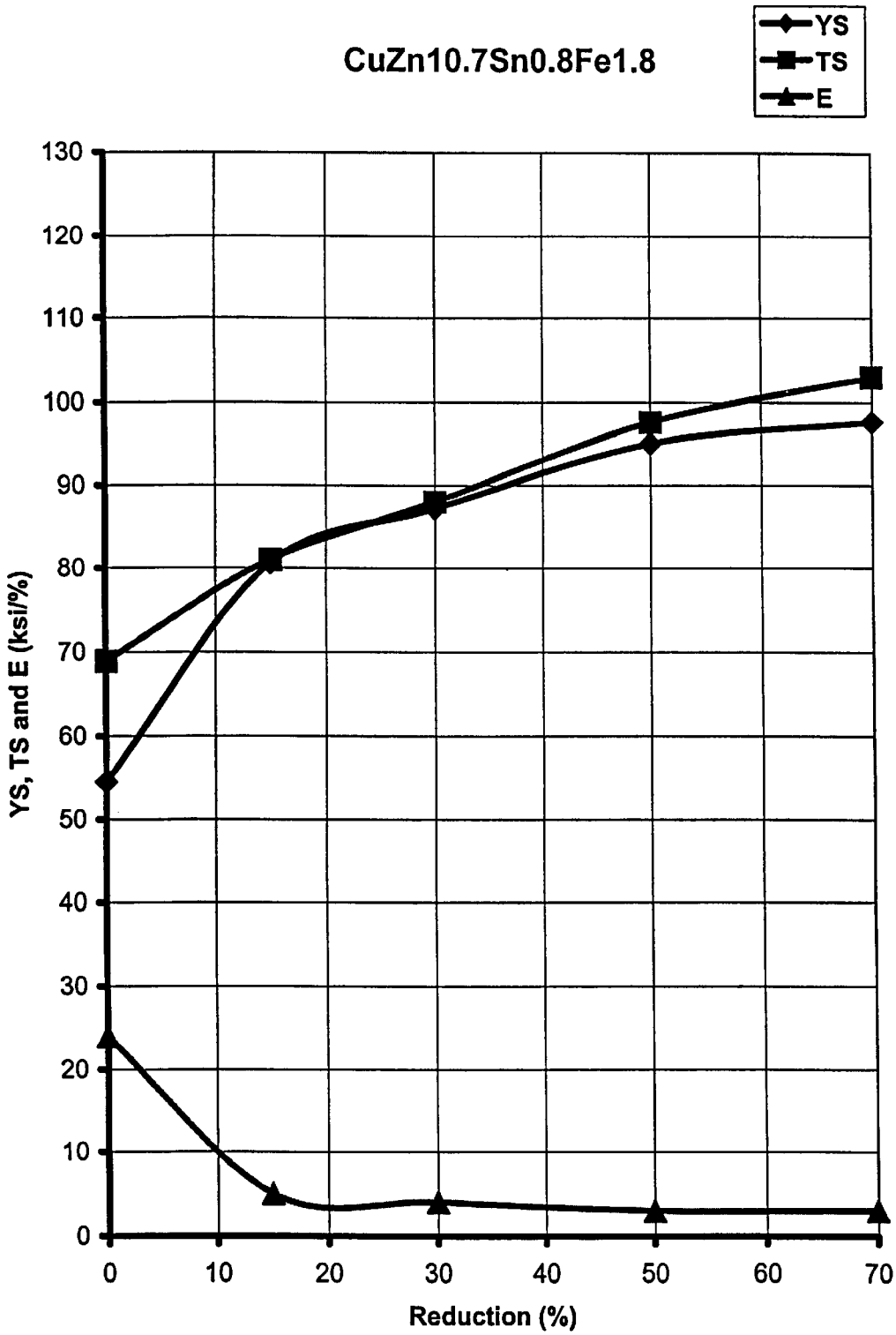
FIG. 3 PRIOR ART
FIG. 3 graphically illustrates the tensile strength and yield strength of a copper alloy outside of the present invention containing 10.7% by weight of zinc, 0.8% by weight of tin, 1.8% by weight of iron, the balance being copper, as the copper alloy is cold rolled up to 70%.

FIG. 3 graphically illustrates the data shown in Table 1 above. As illustrated in FIG. 3, when the tin content of the copper alloy described in Example 2 of the Brauer '505 patent is lowered, as was done in Example 1, this copper alloy of Example 1 results in an undesirable decrease in yield strength to about 98 ksi and tensile strength to about 103 ksi. The 0.2% offset yield strength and the tensile strength were measured on a tensile testing machine (manufactured by Tinius Olsen, Willow Grove, Pa.) according to ASTM E8.

EXAMPLE 2

A Copper alloy containing 14% by weight of zinc, 0.9% by weight of tin, 0.8% by weight of iron and the balance being copper was prepared according to the process of FIG. 1. Table 2, below, illustrates the average mechanical properties of two samples of the copper alloy of this example which was prepared by casting at 180 mm, hot rolling to 91% reduction, milling, rolling to 0.6 mm (95% reduction), and annealing at 510 degrees Celsius for 8 hours to a grain size of 2–3 micrometers.

TABLE 2

| % Reduction | Yield Strength | Tensile Strength | Elongation |
|---|---|---|---|
| 0 | 47.8 | 64.2 | 30 |
| 13.9 | 74.5 | 78.9 | 8.8 |
| 27.1 | 86.5 | 92 | 4.7 |

TABLE 2-continued

| % Reduction | Yield Strength | Tensile Strength | Elongation |
|---|---|---|---|
| 46.2 | 98.4 | 107.6 | 2.5 |
| 68.4 | 105.3 | 115.3 | 2.5 |

Figure 4:
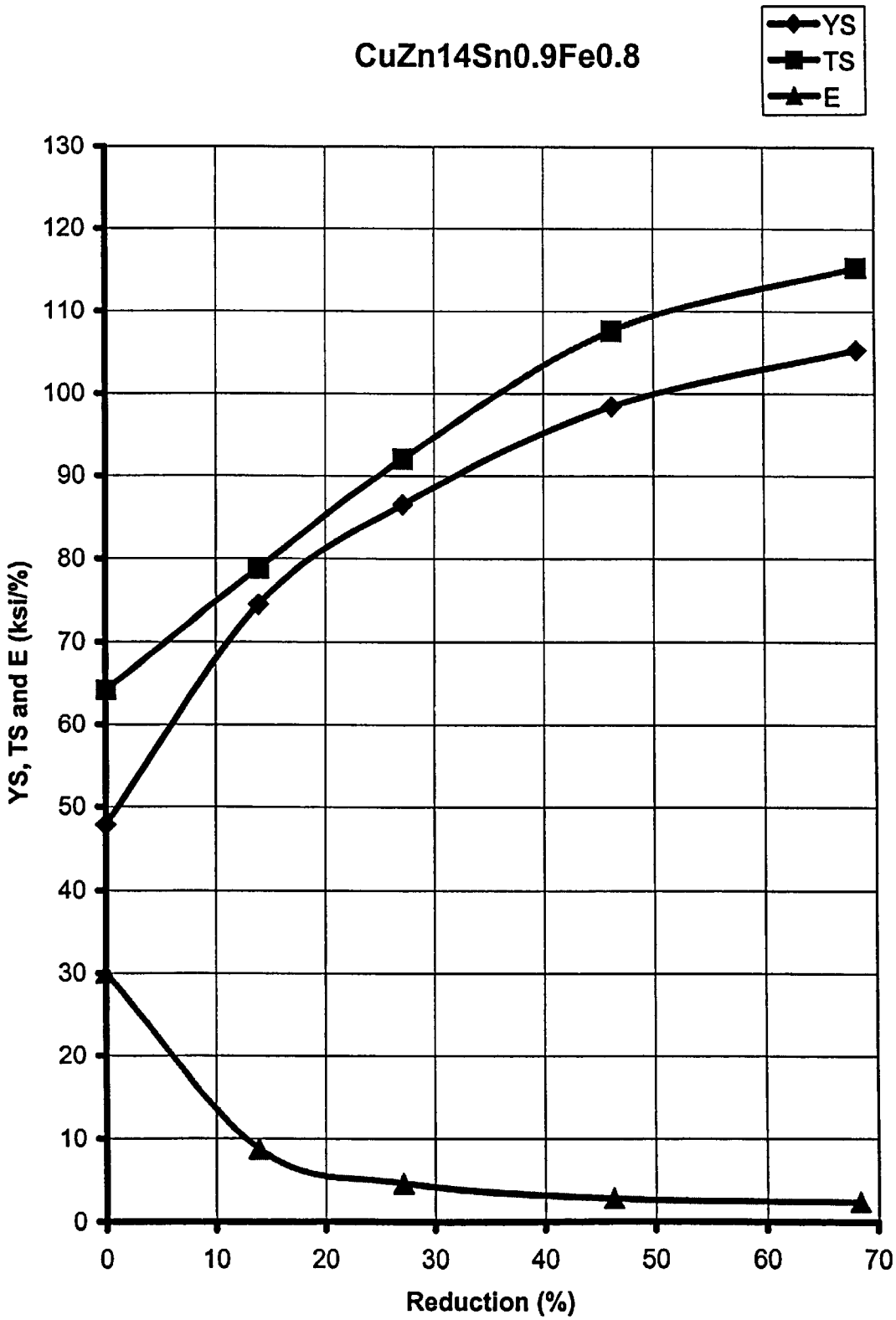
FIG. 4 graphically illustrates the tensile strength and yield strength of a copper alloy of applicants' invention containing 14% by weight of zinc, 0.9% by weight of tin, 0.8% by weight of iron, the balance being copper, as the copper alloy is cold rolled up to 70%.

FIG. 4 graphically illustrates the data shown in Table 2. Using the process as described above, the copper alloy is capable of achieving the desired properties of a tensile strength of about 115 ksi and a yield strength of about 106 ksi. The 0.2% offset yield strength and the tensile strength were measured on a tensile testing machine (manufactured by Tinius Olsen, Willow Grove, Pa.) according to ASTM E8.

As illustrated by comparing FIGS. 3 and 4, both the yield strength and tensile strength of the copper alloy of the present invention are higher than those measured for the copper alloy of Example 1.

It will be apparent to those skilled in the art that various modifications and variations can be made in the device and method of the present invention without departing from the spirit or scope of the invention. Thus, it is intended that the present invention embraces all such modifications and variations within the spirit and scope of the appended claims.

What is claimed is:

1. A copper alloy, consisting of:

13% to 15% by weight of zinc;

0.7% to 0.9% by weight of tin;

0.7% to 0.9% by weight of iron; and the balance being copper.

2. The copper alloy of claim 1, wherein the copper alloy has a tensile strength between 110 and 125 ksi.

3. The copper alloy of claim 2, wherein the copper alloy has a yield strength between 100 and 120 ksi.

4. An electrical connector formed from the alloy of claim 1.

* * * * *